US006786985B2

(12) United States Patent
Kosaka et al.

(10) Patent No.: US 6,786,985 B2
(45) Date of Patent: Sep. 7, 2004

(54) ALPHA-BETA TI-AI-V-MO-FE ALLOY

(75) Inventors: Yoji Kosaka, Henderson, NV (US); Stephen P. Fox, Henderson, NV (US); John C. Fanning, Henderson, NV (US)

(73) Assignee: Titanium Metals Corp., Henderson, NV (US)

( * ) Notice: Subject to any disclaimer, the term of this patent is extended or adjusted under 35 U.S.C. 154(b) by 50 days.

(21) Appl. No.: 10/140,884

(22) Filed: May 9, 2002

(65) Prior Publication Data

US 2003/0211003 A1 Nov. 13, 2003

(51) Int. Cl.[7] ..... C22C 14/00
(52) U.S. Cl. ..... 148/421; 420/421; 420/420
(58) Field of Search ..... 148/421; 420/420, 420/421

(56) References Cited

U.S. PATENT DOCUMENTS 4,810,465 A 3/1989 Kimura et al.
5,156,807 A 10/1992 Nagata et al.
5,244,517 A 9/1993 Kimura et al.
5,362,441 A 11/1994 Ogawa et al.
5,509,979 A 4/1996 Kimura
5,558,728 A * 9/1996 Kobayashi et al. ..... 148/421
5,759,484 A 6/1998 Kashii et al.
5,980,655 A 11/1999 Kosaka
6,228,189 B1 5/2001 Oyama et al.

FOREIGN PATENT DOCUMENTS

JP 7-54081 2/1995

* cited by examiner

*Primary Examiner*—George Wyszomierski
*Assistant Examiner*—Janelle Morillo
(74) *Attorney, Agent, or Firm*—Finnegan, Henderson, Farabow, Garrett & Dunner LLP

(57) ABSTRACT

High strength alpha-beta alloy comprising essentially Al: 4.5–5.5%, V: 3.0–5.0%, Mo: 0.3–1.8%, Fe: 0.2–1.2%, oxygen 0.12–0.25% Ti: balance. All other incidental elements should be less than 0.1% for each element and less than 0.5% in total. The alloy possesses improved machinability and ballistic performance compared to Ti-6Al-4V.

5 Claims, No Drawings

ALPHA-BETA TI-AI-V-MO-FE ALLOY

DESCRIPTION OF THE INVENTION

BACKGROUND OF THE INVENTION

The invention relates to a high strength alpha-beta alloy having an improved combination of strength, machinability and ballistic properties.

Titanium base alloys are used in applications requiring high strength-to-weight ratios, along with elevated temperature properties and corrosion resistance. These alloys may be characterized as alpha phase alloys, beta phase alloys, or alpha-beta alloys. The alpha-beta alloys contain one or more alpha stabilizing elements and one or more beta stabilizing elements. These alloys can be strengthened by heat treatment or thermo-mechanical processing. Specifically, the alloys may be strengthened by rapid cooling from a high temperature in the alpha-beta range or above the beta transus temperature. This procedure, known as solution treatment, is followed by an intermediate-temperature treatment, termed aging, to result in a desired mixture of alpha and transformed beta phases as the principle phases in the microstructure of the alloy.

It is desirable to use these alloys in applications requiring a combination of high strength, good machinability and ballistic properties.

It is accordingly an object of the present invention to provide an alpha-beta titanium-based alloy having this desired combination of properties.

SUMMARY OF THE INVENTION

Alpha-beta titanium alloy, comprising:

Al: 4.5 to 5.5 wt %

V: 3.0 to 5.0 wt % (preferably 3.7 to 4.7 wt %)

Mo: 0.3 to 1.8 wt %

Fe: 0.2 to 1.2 wt % (preferably 0.2 to 0.8 wt %)

O: 0.12 to 0.25 wt % (preferably 0.15 to 0.22 wt %)

Balance titanium and incidental elements and impurities with each being less than 0.1 wt % and 0.5 wt % total.

The alloys in accordance with the invention have aluminum as an essential element within the composition limits of the invention. If aluminum is lower than 4.5%, sufficient strength will not be obtained. Likewise, if aluminum is higher than 5.5%, machinability will be inferior.

Vanadium is an essential element as a beta stabilizer in the alpha-beta titanium alloys in accordance with the invention.

If vanadium is less than 3.0%, sufficient strength will not be obtained. Likewise, if vanadium is higher than 5.0%, the beta-stabilizer content of the alloy will be too high resulting in degradation of machinability.

Iron is present as an effective and less expensive beta stabilizing element. Normally, approximately 0.1% iron results from the sponge titanium and other recycle materials used in the production of the alloy in accordance with the invention. Otherwise, iron may be added as steel or as ferro-molybdenum master alloy since the alloy of the invention has molybdenum as an essential element. If iron is higher than about 1.2%, machinability will be adversely affected.

Molybdenum is an effective element to stabilize the beta phase, as well as providing for grain refinement of the microstructure. If molybdenum is less than 0.3%, its desired effects will not be obtained. Likewise, if molybdenum is higher than 1.8%, machinability will be degraded.

Oxygen is a strengthening element in titanium and its alloys. If oxygen is lower than 0.12%, sufficient strength will not be obtained, and if oxygen is higher than 0.25%, brittleness will occur and machinability will be deteriorated.

DETAILED DESCRIPTION AND SPECIFIC EXAMPLES

EXAMPLE 1

Ten 8 inch diameter ingots including Ti-6Al-4V were made with double VAR (Vacuum Arc Remelting) methods in a laboratory scale. The chemical compositions of these ingots are shown in Table 1. In the table, alloys A, B, C and E are invented alloys. Alloys D and F through J are controlled alloys. Alloy J is Ti-6Al-4V, which is the most common alpha-beta alloy. These ingots were forged and rolled to ¾" square bars or ¾" thick plates with alpha-beta processing. A part of the materials was mill annealed at 1300F for 1 hour followed by air cooling in order to examine basic characteristics of each alloy. In addition, solution treatment and aging (STA) was carried out for each bar, and then mechanical properties were evaluated to examine the hardenability of the alloys.

Table 2 shows tensile properties of the alloys after mill anneal. Alloys A, B, C and E show equivalent strength (UTS or 0.2% PS) to Ti-6Al-4V. Ductility (EI and RA) of A, B, C and E are better than that of Ti-6Al-4V. Table 3 shows tensile properties of experimental alloys after STA together with Ti-6Al-4V. Alloys A, B and C show higher strength (UTS or 0.2% PS) than that of Ti-6Al-4V by at least 10 ksi. The higher strength after STA is due primarily to the improved hardenability by addition of Mo and/or Fe. However, if Mo and/or Fe content is too high, ductility becomes low as seen in alloys G, H, and I.

TABLE 1

Chemical Composition of Alloys (weight % except H with ppm))

| Alloy | Alloy | Al | V | Mo | Fe | Si | O | Note |
|---|---|---|---|---|---|---|---|---|
| A | Ti-5A1-4V-1Mo-0.6Fe | 4.94 | 3.97 | 0.99 | 0.57 | 0.03 | 0.19 | Invention |
| B | Ti-5Al-4V-0.5Mo-0.4Fe | 4.95 | 3.96 | 0.51 | 0.38 | 0.03 | 0.18 | Invention |
| C | Ti-5Al-4V-0.5Mo-0.4Fe-0.08Si | 4.95 | 3.98 | 0.50 | 0.39 | 0.07 | 0.18 | Invention |
| D | Ti-5Al-4V-0.5Mo-0.4Fe-0.35Si | 4.93 | 4.02 | 0.51 | 0.39 | 0.30 | 0.17 | Comparison |
| E | Ti-5Al-4V-1.5Mo-1Fe | 4.84 | 3.95 | 1.52 | .099 | 0.03 | 0.16 | Invention |
| F | Ti-4Al-4V-1.5Mo-1Fe | 3.94 | 3.95 | 1.51 | 0.98 | 0.03 | 0.22 | Comparison |
| G | Ti-4Al-4V-2Mo-1.3Fe | 3.92 | 3.91 | 2.01 | 1.26 | 0.03 | 0.19 | Comparison |
| H | Ti-4Al-4Mo0.5Si | 3.95 | <.001 | 3.88 | 0.20 | 0.47 | 0.21 | Comparison |
| I | Ti-4Al-2Mo-1.3Fe-0.5Si | 3.90 | <.001 | 2.03 | 1.28 | 0.45 | 0.19 | Comparison |
| J | Ti-6Al-4V | 5.96 | 4.06 | 0.02 | 0.03 | 0.02 | 0.17 | Comparison |

TABLE 2

Tensile Properties of Mill Annealed Bars

| Alloy | UTS (ksi) | 0.2% PS (ksi) | El (%) | RA (%) |
|---|---|---|---|---|
| A | 147.6 | 145.6 | 17 | 57.9 |
| B | 144.2 | 142.1 | 17 | 53.7 |
| C | 146.4 | 138.0 | 17 | 52.1 |
| D | 151.8 | 143.9 | 13 | 42.0 |
| E | 153.3 | 147.0 | 15 | 56.0 |
| F | 152.6 | 144.5 | 17 | 56.1 |
| G | 153.2 | 146.9 | 17 | 54.0 |
| H | 154.9 | 146.6 | 15 | 41.6 |
| I | 154.4 | 146.4 | 15 | 40.7 |
| J | 146.7 | 134.2 | 15 | 44.3 |

TABLE 3

Tensile Properties of Solution Treat and Aged Bars

| Alloy | UTS (ksi) | 0.2% PS (ksi) | El (%) | RA (%) |
|---|---|---|---|---|
| A | 181.9 | 170.2 | 13 | 49.8 |
| B | 170.0 | 159.7 | 13 | 51.3 |
| C | 169.4 | 153.3 | 17 | 57.2 |
| D | 180.4 | 165.3 | 13 | 48.6 |
| E | 194.1 | 183.5 | 12 | 40.4 |
| F | 189.5 | 172.8 | 12 | 40.5 |
| G | 195.5 | 185.0 | 10 | 35.2 |
| H | 203.4 | 186.8 | 10 | 32.1 |
| I | 187.5 | 169.4 | 9 | 32.1 |
| J | 159.0 | 144.5 | 15 | 53.3 |

El=elongation

RA=reduction in area

UTS=ultimate tensile strength 0.2% PS=0.2% proof (yield) strength

EXAMPLE 2

Mill annealed plates with the thickness of ¾" were machined to ⅝" thickness plates. Drill test was performed on these plates in order to evaluate the machinability of the alloys. High Speed Steel Drills (AISI M42) were used for the test. The following are the conditions of the drill test.

Diameter of Drill: ¼"

Depth of Hole: ⅝" through hole

Feed: 0.0075"/rev.

Rotational Speed: 500 RPM

Coolant: Water soluble coolant

Drill life was determined when the drill could not drill any holes due to the damage of its tip. The results of the drill tests are set forth in Table 4. Relative drill index in Table 4 is an average of 2 to 3 tests. The drill test was terminated when its relative index became higher than about 4.0. The drill test indicated that the invention alloys possess significantly superior machinability than Ti-6Al-4V and other alloys outside of the chemical composition of the alloy of the present invention. Inferior machinability of Alloy F is due to high content of oxygen.

TABLE 4

Results of Drill Test

| Alloy | Alloy Type | Relative Drill Index | Remarks |
|---|---|---|---|
| A | Ti-5Al-4V-1Mo-0.6Fe-0.19 Oxygen | >4.3 | Invention |
| B | Ti-5Al-4V-0.5Mo-0.4Fe-0.18 Oxygen | >4.2 | Invention |
| D | Ti-5Al-4V-0.5Mo-0.4Fe-0.35Si-0.17 Oxygen | >4.3 | Invention |
| E | Ti-5Al-4V-1.5Mo-1Fe-0.16 Oxygen | >4.0 | Invention |
| F | Ti-4Al-4V-1.5Mo-1Fe-0.22 Oxygen | 0.2 | Comparison |
| G | Ti-4Al-2Mo-1.3Fe-0.19 Oxygen | 1.5 | Comparison |
| H | Ti-4Al-4Mo-0.5Si-0.21 Oxygen | 1.8 | Comparison |
| I | Ti-4Al-2Mo-1.3Fe-0.5Si-0.19 Oxygen | 0.2 | Comparison |
| J | Ti-6Al-4V-0.17 Oxygen | 1.0 | Comparison |

EXAMPLE 3

A plate with a thickness of approximately 0.43" was produced by alpha-beta processing starting from a laboratory 8 inch diameter ingot. This plate was mill annealed followed by pickling. A 50-caliber FSP (Fragment Simulating Projectile) was used as a projectile. A $V_{50}$, which is a velocity of projectile that gives a 50% chance of complete penetration, was determined for each plate and compared with the specification. The results are shown in Table 5. The $\Delta V_{50}$ in the table indicates the difference of $V_{50}$ between measured value and specification. Therefore, a positive number indicates superiority against the specification. As shown in the table, alloy K exhibits a superior ballistic property to Ti-6Al-4V.

TABLE 5

Results of Ballistic Properties

| Alloy | Al | V | Mo | Fe | O | $\Delta V_{50}$(FSP) | Remarks |
|---|---|---|---|---|---|---|---|
| K | 4.94 | 4.09 | 0.538 | 0.371 | 0.171 | 237 | Invention |
| Ti-6Al-4V | | | | | | −323 | Comparison |

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An alpha-beta titanium-base alloy comprising in weight percent:

4.5 to 5.5 aluminum;

3.0 to 5.0 vanadium;

0.3 to 1.8 molybdenum;

0.2 to 0.8 iron;

0.12 to 0.25 oxygen: and balance titanium and incidental elements and impurities, with said incidental elements each being less than 0.1 and in total less than 0.5.

2. The alloy of claim 1 comprising 3.7 to 4.7 vanadium.

3. The alloy of claim 1 comprising 0.15 to 0.22 oxygen.

4. An alpha-beta titanium-base alloy comprising, in weight percent:

4.5 to 5.5 aluminum;

3.7 to 4.7 vanadium;

0.3 to 1.8 molybdenum;

0.2 to 0.8 iron;

0.12 and 0.25 oxygen; and balance titanium and incidental elements and impurities, with said incidental elements each being less than 0.1 and in total less than 0.5.

5. The alloy of claim 4 comprising 0.15 to 0.22.

* * * * *

UNITED STATES PATENT AND TRADEMARK OFFICE

CERTIFICATE OF CORRECTION

PATENT NO. : 6,786,985 B2 
DATED : September 7, 2004
INVENTOR(S) : Yoji Kosaka, Stephen P. Fox and John C. Fanning It is certified that error appears in the above-identified patent and that said Letters Patent is hereby corrected as shown below:

Title page,
Item [54], Title, "TI-AI-V-MO-FE" should read -- TI-AL-V-MO-FE --.

Column 6,
Line 12, "0.15 to 0.22." should read -- 0.15 to 0.22 oxygen. --.

Signed and Sealed this

Thirtieth Day of November, 2004

JON W. DUDAS
*Director of the United States Patent and Trademark Office*